US010030819B2

(12) United States Patent
Athalye

(10) Patent No.: US 10,030,819 B2
(45) Date of Patent: Jul. 24, 2018

(54) LED LAMP AND HEAT SINK

(71) Applicant: Cree, Inc., Durham, NC (US)

(72) Inventor: Praneet Jayant Athalye, Morrisville, NC (US)

(73) Assignee: Cree, Inc., Durham, NC (US)

( * ) Notice: Subject to any disclaimer, the term of this patent is extended or adjusted under 35 U.S.C. 154(b) by 0 days.

(21) Appl. No.: 14/168,230

(22) Filed: Jan. 30, 2014

(65) Prior Publication Data

US 2015/0211723 A1 Jul. 30, 2015

(51) Int. Cl.

| | |
|---|---|
| ***F21K 99/00*** | (2016.01) |
| ***F21V 29/00*** | (2015.01) |
| ***F21V 29/77*** | (2015.01) |
| ***F21K 9/232*** | (2016.01) |
| ***F21K 9/233*** | (2016.01) |

(52) U.S. Cl.

CPC ..... *F21K 9/135* (2013.01); *F21K 9/232* (2016.08); *F21K 9/233* (2016.08); *F21V 29/004* (2013.01); *F21V 29/77* (2015.01)

(58) Field of Classification Search

CPC .... F21V 29/2225; F21V 29/00; F21V 29/004; F21K 9/135; F21K 9/137

USPC ..... 362/311.02, 294, 373, 235, 345, 218, 362/240, 650

See application file for complete search history.

(56) References Cited

U.S. PATENT DOCUMENTS

| | | | |
|---|---|---|---|
| 3,581,162 | A | 5/1971 | Wheatley |
| 5,463,280 | A | 10/1995 | Johnson |
| 5,561,346 | A | 10/1996 | Byrne |
| 5,585,783 | A | 12/1996 | Hall |
| 5,655,830 | A | 8/1997 | Ruskouski |
| 5,688,042 | A | 11/1997 | Madadi et al. |
| 5,806,965 | A | 9/1998 | Deese |
| 5,947,588 | A | 9/1999 | Huang |
| 5,949,347 | A | 9/1999 | Wu |
| 6,220,722 | B1 | 4/2001 | Begemann |
| 6,227,679 | B1 | 5/2001 | Zhang et al. |
| 6,234,648 | B1 | 5/2001 | Borner et al. |
| 6,250,774 | B1 | 6/2001 | Begemann et al. |

(Continued)

FOREIGN PATENT DOCUMENTS

| | | | |
|---|---|---|---|
| EP | 1058221 | A2 | 12/2000 |
| EP | 0890059 | B1 | 6/2004 |

(Continued)

*Primary Examiner* — Anh Mai
*Assistant Examiner* — Arman B Fallahkhair
(74) *Attorney, Agent, or Firm* — Dennis J. Williamson; Moore & Van Allen PLLC

(57) ABSTRACT

A lamp has an at least partially optically transmissive enclosure and a base that retains lamp electronics. LEDs are located in the enclosure and are operable to emit light when energized through an electrical path from the base. The LEDs are thermally isolated from the lamp electronics in the base. A heat sink is disposed between the base and the enclosure. The heat sink includes a heat conducting portion that is thermally coupled to the LEDs and a heat dissipating portion that is exposed to the ambient environment. The heat dissipating portion includes fins that have inner edges and create spaces between adjacent ones of the fins. The inner edges are spaced from one another to define an interior open space where the interior open space communicates with the spaces between the fins.

14 Claims, 6 Drawing Sheets

(56) References Cited

U.S. PATENT DOCUMENTS 6,276,822 B1 8/2001 Bedrosian et al.
6,465,961 B1 10/2002 Cao
6,523,978 B1 2/2003 Huang
6,550,953 B1 4/2003 Ichikawa et al.
6,634,770 B2 10/2003 Cao
6,659,632 B2 12/2003 Chen
6,709,132 B2 3/2004 Ishibashi
6,803,607 B1 10/2004 Chan et al.
6,848,819 B1 2/2005 Arndt et al.
6,864,513 B2 3/2005 Lin et al.
6,948,829 B2 9/2005 Verdes et al.
6,982,518 B2 1/2006 Chou et al.
7,048,412 B2 5/2006 Martin et al.
7,080,924 B2 7/2006 Tseng et al.
7,086,756 B2 8/2006 Maxik
7,086,767 B2 8/2006 Sidwell et al.
7,144,135 B2 12/2006 Martin et al.
7,165,866 B2 1/2007 Li
7,172,314 B2 2/2007 Currie et al.
7,213,940 B1 5/2007 Van De Ven et al.
7,281,818 B2 * 10/2007 You et al. ..... 362/241
7,354,174 B1 4/2008 Yan
7,396,142 B2 7/2008 Laizure, Jr. et al.
7,575,346 B1 * 8/2009 Horng ..... F21V 29/02 362/294
7,600,882 B1 10/2009 Morejon et al.
7,631,987 B2 * 12/2009 Wei ..... F21V 29/004 361/703
7,726,836 B2 6/2010 Chen
7,824,065 B2 11/2010 Maxik
7,874,710 B2 * 1/2011 Tsai ..... F21V 29/004 362/294
7,932,532 B2 * 4/2011 Pickard ..... F21V 29/004 257/98
7,938,558 B2 5/2011 Wilcox et al.
7,965,023 B1 6/2011 Liang
8,021,025 B2 9/2011 Lee
8,083,383 B2 * 12/2011 Chen ..... F21V 29/507 362/294
8,092,042 B2 1/2012 Wilcox
8,164,236 B2 * 4/2012 Huang ..... F21V 3/00 313/11
8,227,960 B2 * 7/2012 Huang ..... F21K 9/137 313/46
8,253,316 B2 8/2012 Sun et al.
8,272,762 B2 9/2012 Maxik et al.
8,274,241 B2 * 9/2012 Guest ..... F21K 9/135 313/46
8,277,082 B2 10/2012 Dassanayake et al.
8,282,249 B2 10/2012 Liang et al.
8,282,250 B1 10/2012 Dassanayake et al.
8,292,468 B2 10/2012 Narendran et al.
8,317,358 B2 * 11/2012 Chou ..... F21V 29/006 362/218
8,322,896 B2 12/2012 Falicoff et al.
8,371,722 B2 2/2013 Carroll
8,400,051 B2 3/2013 Hakata et al.
8,415,865 B2 4/2013 Liang et al.
8,421,320 B2 4/2013 Chuang
8,421,321 B2 4/2013 Chuang
8,421,322 B2 4/2013 Carroll et al.
8,427,037 B2 4/2013 Liang et al.
8,449,154 B2 5/2013 Uemoto et al.
8,502,468 B2 8/2013 Li et al.
8,547,003 B2 * 10/2013 Wu ..... F21K 9/00 165/185
8,556,465 B2 10/2013 Lee et al.
8,575,826 B1 * 11/2013 Huang ..... F21V 29/77 313/46
8,591,063 B2 * 11/2013 Yoneda ..... F21K 9/135 362/249.02
8,641,237 B2 2/2014 Chuang
8,653,723 B2 2/2014 Cao et al.
8,696,168 B2 4/2014 Li et al.
8,740,415 B2 6/2014 Wheelock
8,750,671 B1 6/2014 Kelly et al.
8,752,984 B2 6/2014 Lenk et al.
8,760,042 B2 6/2014 Sakai et al.
8,967,836 B2 * 3/2015 Min ..... F21V 17/12 362/249.02
8,967,837 B2 * 3/2015 Tsuei ..... F21K 9/1355 362/235
2004/0201990 A1 10/2004 Meyer
2007/0253202 A1 * 11/2007 Wu ..... F21V 29/006 362/294
2009/0184618 A1 7/2009 Hakata et al.
2010/0073944 A1 * 3/2010 Chen ..... 362/373
2011/0068687 A1 * 3/2011 Takahasi et al. ..... 315/35
2011/0273102 A1 11/2011 Van De Ven et al.
2012/0040585 A1 2/2012 Huang
2012/0057356 A1 * 3/2012 Hizer et al. ..... 362/373
2012/0188767 A1 * 7/2012 Igaki et al. ..... 362/249.04
2012/0300429 A1 * 11/2012 Jin ..... 362/84
2013/0010479 A1 * 1/2013 Chen et al. ..... 362/373
2013/0026923 A1 1/2013 Athalye et al.
2013/0026925 A1 1/2013 Ven et al.
2013/0069535 A1 3/2013 Athalye
2013/0069547 A1 3/2013 Van De Ven et al.
2013/0127353 A1 5/2013 Athalye et al.
2013/0162149 A1 6/2013 Van De Ven et al.
2013/0162153 A1 6/2013 Van De Ven et al.
2013/0169159 A1 7/2013 Lys
2013/0293135 A1 11/2013 Hu et al.

FOREIGN PATENT DOCUMENTS

GB 2345954 A 7/2000
JP H09265807 A 10/1997
JP 2000173304 A 6/2000
JP 2001118403 A 4/2001
JP 2007059930 A 3/2007
JP 2008288183 A 11/2008
JP 2009117346 A 5/2009
JP 3153766 U 9/2009
JP 2009277586 A 11/2009
WO 0124583 A1 4/2001
WO 0160119 A2 8/2001
WO 2012011279 A1 1/2012
WO 2012031533 A1 3/2012

* cited by examiner

LED LAMP AND HEAT SINK

BACKGROUND

Light emitting diode (LED) lighting systems are becoming more prevalent as replacements for legacy lighting systems. LED systems are an example of solid state lighting (SSL) and have advantages over traditional lighting solutions such as incandescent and fluorescent lighting because they use less energy, are more durable, operate longer, can be combined in multi-color arrays that can be controlled to deliver virtually any color light, and generally contain no lead or mercury. A solid-state lighting system may take the form of a luminaire, lighting unit, light fixture, light bulb, or a "lamp."

An LED lighting system may include, for example, a packaged light emitting device including one or more light emitting diodes (LEDs), which may include inorganic LEDs, which may include semiconductor layers forming p-n junctions and/or organic LEDs (OLEDs), which may include organic light emission layers. Light perceived as white or near-white may be generated by a combination of red, green, and blue ("RGB") LEDs. Output color of such a device may be altered by separately adjusting supply of current to the red, green, and blue LEDs. Another method for generating white or near-white light is by using a lumiphor such as a phosphor. Still another approach for producing white light is to stimulate phosphors or dyes of multiple colors with an LED source. Many other approaches can be taken.

An LED lamp may be made with a form factor that allows it to replace a standard incandescent bulb, or any of various types of fluorescent lamps. LED lamps often include some type of optical element or elements to allow for localized mixing of colors, collimate light, or provide a particular light pattern. Sometimes the optical element also serves as an envelope or enclosure for the electronics and or the LEDs in the lamp.

Since, ideally, an LED lamp designed as a replacement for a traditional incandescent or fluorescent light source needs to be self-contained; a power supply is included in the lamp structure along with the LEDs or LED packages and the optical components. A heatsink is also often needed to cool the LEDs and/or power supply in order to maintain appropriate operating temperature.

SUMMARY OF THE INVENTION

In some embodiments, a lamp comprises an at least partially optically transmissive enclosure. A base retains lamp electronics. At least one LED may be located in the enclosure and may be operable to emit light when energized through an electrical path from the base. A heat sink comprises a heat dissipating portion that is at least partially exposed to the ambient environment where the heat dissipating portion is configured to allow air flow radially across the heat sink.

The enclosure may be entirely optically transmissive. The enclosure may comprise a reflective surface and an optically transmissive exit surface through which light is emitted from the lamp. The reflective surface may generate a directional light pattern. The reflective surface may be parabolic. The heat dissipating portion may comprise a plurality of fins. The plurality of fins may define a plurality of inner edges and the inner edges may be spaced from one another to define an interior open space. An electrical conductor may connect the at least one LED to the base where the electrical conductor may extend through the interior open space. The inner edges of the plurality of fins may be flared to cover the interior open space. A tube may be located in the interior open space. The electrical conductor may extend through the tube. The heat sink may comprise a heat conducting portion that is thermally coupled to the at least one LED and to the heat dissipating portion. The heat dissipating portion and the heat conducting portion may be a single piece. The heat conducting portion may form a tower that extends into the enclosure. The heat conducting portion may define a planar member disposed at a first end of the enclosure. A LED board may support the at least one LED and may be mounted on the heat conducting portion. The LED board may be thermally conductive. A cover may be disposed over the LED board comprising an aperture through which the at least one LED emits light where the cover is electrically non-conductive. The base may comprise an Edison screw.

In some embodiments a lamp comprises an at least partially optically transmissive enclosure. A base comprises lamp electronics. A plurality of LEDs are located in the enclosure and are operable to emit light when energized through an electrical path from the base. A heat sink comprises a heat conducting portion that is thermally coupled to the plurality of LEDs and a heat dissipating portion that is at least partially exposed to the ambient environment. The heat dissipating portion configured such that the heat sink spaces the lamp electronics from the plurality of LEDs and air may circulate across the heat conducting portion.

The heat dissipating portion comprises a plurality of fins that define a plurality of inner edges and a plurality of spaces between adjacent ones of the plurality of fins where the inner edges may be spaced from one another to define an interior open space where the interior open space communicates with the plurality of spaces. The base may comprise an Edison screw.

DETAILED DESCRIPTION

Figure 1:
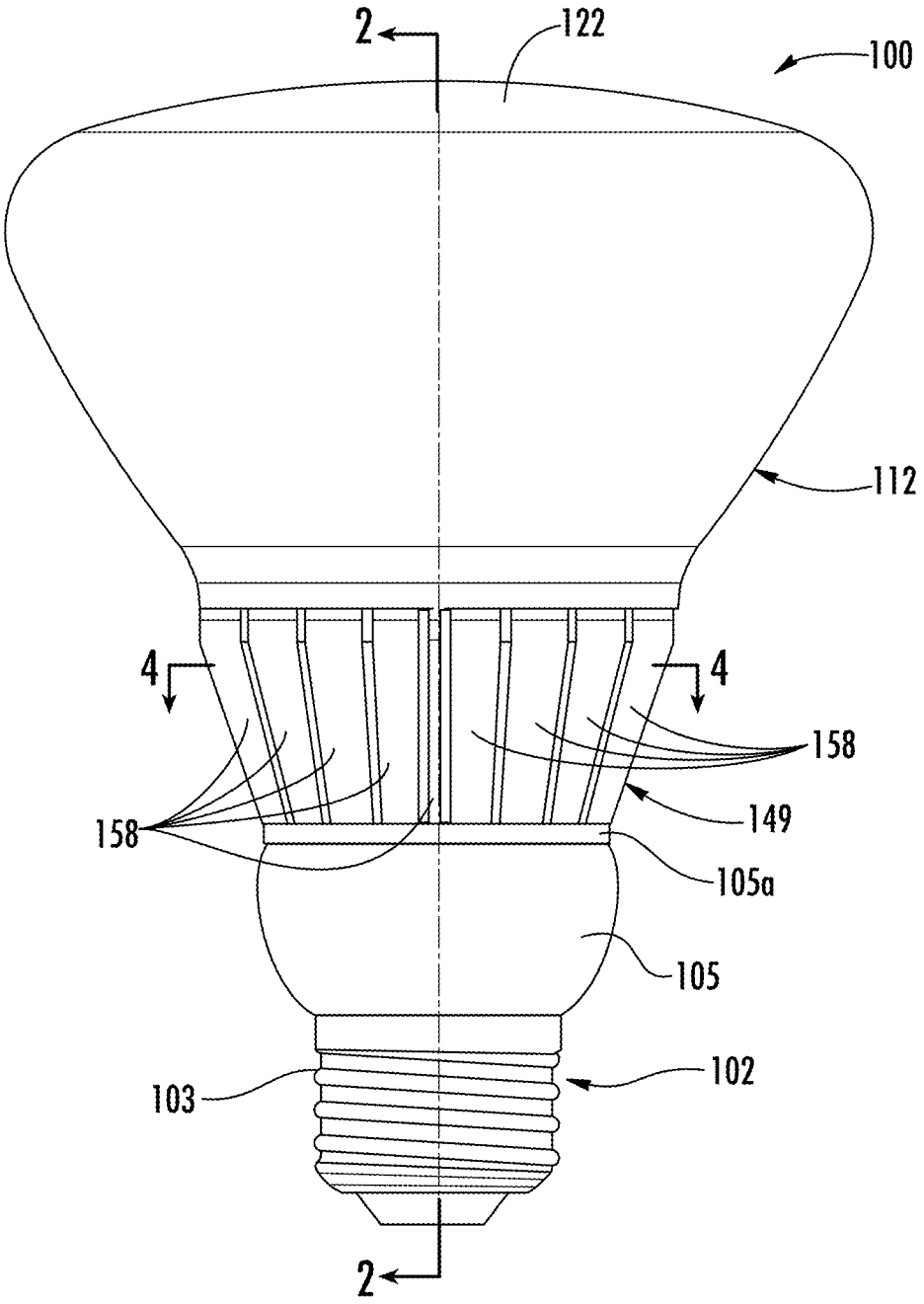
FIG. 1 is a plan view of an embodiment of a lamp of the invention.

Embodiments of the present invention now will be described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present invention. As used herein, the term "and/or" includes any and all combinations of one or more of the associated listed items.

It will be understood that when an element such as a layer, region or substrate is referred to as being "on" or extending "onto" another element, it can be directly on or extend directly onto the other element or intervening elements may also be present. In contrast, when an element is referred to as being "directly on" or extending "directly onto" another element, there are no intervening elements present. It will also be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

Relative terms such as "below" or "above" or "upper" or "lower" or "horizontal" or "vertical" or "top" or "bottom" may be used herein to describe a relationship of one element, layer or region to another element, layer or region as illustrated in the figures. It will be understood that these terms are intended to encompass different orientations of the device in addition to the orientation depicted in the figures.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" "comprising," "includes" and/or "including" when used herein, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms used herein should be interpreted as having a meaning that is consistent with their meaning in the context of this specification and the relevant art and will not be interpreted in an idealized or overly formal sense unless expressly so defined herein.

Unless otherwise expressly stated, comparative, quantitative terms such as "less" and "greater", are intended to encompass the concept of equality. As an example, "less" can mean not only "less" in the strictest mathematical sense, but also, "less than or equal to."

The terms "LED" and "LED device" as used herein may refer to any solid-state light emitter. The terms "solid state light emitter" or "solid state emitter" may include a light emitting diode, laser diode, organic light emitting diode, and/or other semiconductor device which includes one or more semiconductor layers, which may include silicon, silicon carbide, gallium nitride and/or other semiconductor materials, a substrate which may include sapphire, silicon, silicon carbide and/or other microelectronic substrates, and one or more contact layers which may include metal and/or other conductive materials. A solid-state lighting device produces light (ultraviolet, visible, or infrared) by exciting electrons across the band gap between a conduction band and a valence band of a semiconductor active (light-emitting) layer, with the electron transition generating light at a wavelength that depends on the band gap. Thus, the color (wavelength) of the light emitted by a solid-state emitter depends on the materials of the active layers thereof. In various embodiments, solid-state light emitters may have peak wavelengths in the visible range and/or be used in combination with lumiphoric materials having peak wavelengths in the visible range. Multiple solid state light emitters and/or multiple lumiphoric materials (i.e., in combination with at least one solid state light emitter) may be used in a single device, such as to produce light perceived as white or near white in character. In certain embodiments, the aggregated output of multiple solid-state light emitters and/or lumiphoric materials may generate warm white light output having a color temperature range of from about 2200K to about 6000K.

Solid state light emitters may be used individually or in combination with one or more lumiphoric materials (e.g., phosphors, scintillators, lumiphoric inks) and/or optical elements to generate light at a peak wavelength, or of at least one desired perceived color (including combinations of colors that may be perceived as white). Inclusion of lumiphoric (also called 'luminescent') materials in lighting devices as described herein may be accomplished by direct coating on solid state light emitter, adding such materials to encapsulants, adding such materials to lenses, by embedding or dispersing such materials within lumiphor support elements, and/or coating such materials on lumiphor support elements. Other materials, such as light scattering elements (e.g., particles) and/or index matching materials, may be associated with a lumiphor, a lumiphor binding medium, or a lumiphor support element that may be spatially segregated from a solid state emitter.

It should also be noted that the term "lamp" is meant to encompass not only a solid-state replacement for a traditional incandescent bulb as illustrated herein, but also replacements for fluorescent bulbs, replacements for complete fixtures, and any type of light fixture that may be custom designed as a solid state fixture for mounting on walls, in or on ceilings, on posts, and/or on vehicles.

Figure 2:
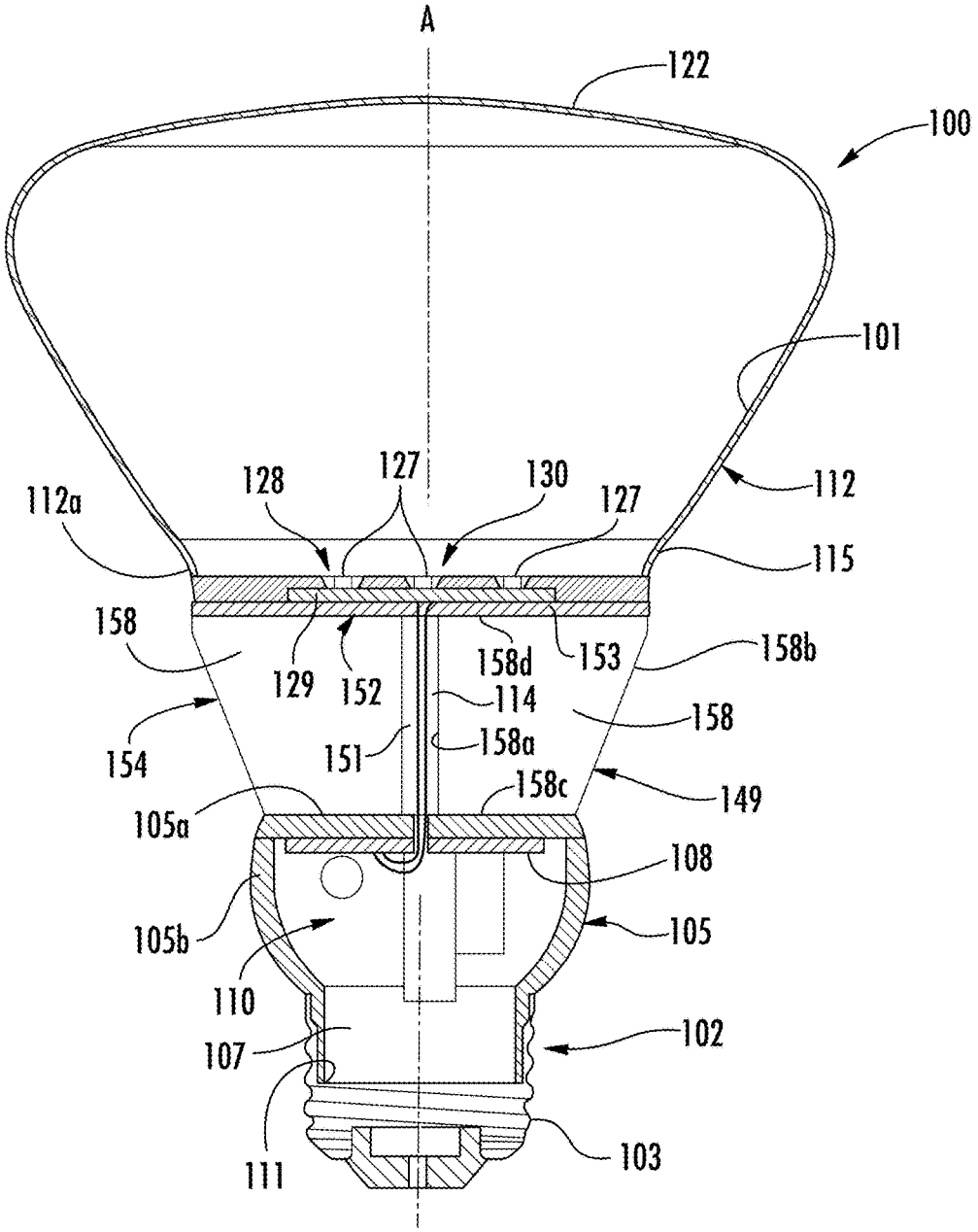
FIG. 2 is a section view taken along line 2-2 of FIG. 1.

FIGS. 1 and 2 show a lamp, 100, according to some embodiments of the present invention. The lamp of FIGS. 1 and 2 is embodied in a BR and/or PAR type lamp. Standard BR type bulbs are reflector bulbs where the internal reflective surface 101 of enclosure 112 reflects light such that the light beam is emitted in a directional pattern; however, the beam angle is not tightly controlled and may be up to about 90-100 degrees or other fairly wide angles. Standard PAR bulbs are reflector bulbs that reflect light in a direction where the reflective surface 101 is a parabola and the beam angle is tightly controlled. PAR lamps may direct the light in a pattern having a tightly controlled beam angle such as, but not limited to, 10°, 25° and 40°. The bulb shown in FIGS. 1 and 2 may be used as a solid state replacement for such BR, PAR or other reflector type bulbs or other similar bulbs where the reflective surface 101 and lens optics may be used to control the beam angle. In another embodiment, shown in FIG. 3, the lamp of the invention may be embodied in an omnidirectional lamp such as lamp 1100 that may be used as a replacement for an A series lamp including but not limited to an A19, A21 or A23 bulb. In an omnidirectional lamp such as lamp 1100 the light is emitted in a wide omnidirectional pattern. The lamp of the invention may be embodied in different forms including standard and non-standard form factors.

Lamp 100, 1100 may be used with an Edison base 102. A lamp base, such as the Edison base 102, functions as the electrical connector to connect the lamp 100, 1100 to an electrical socket or other connector. Depending on the embodiment, other base configurations are possible to make the electrical connection such as other standard bases or non-standard bases. The base 102 comprises an electrically conductive Edison screw 103 for connecting to an Edison socket and a housing 105 connected to the Edison screw. The Edison screw 103 may be connected to the housing 105 by adhesive, mechanical connector, welding, separate fasteners or the like. The housing 105 may be made of an electrically and thermally insulating material such as plastic. Using a thermally insulating material thermally decouples the heat sink from the lamp electronics such that the lamp electronics are not adversely affected by heat generated by the LEDs. The housing 105 and the Edison screw 103 define an internal cavity 107 for receiving the electronics 110 of the lamp including the power supply and/or drivers or a portion of the electronics for the lamp. The lamp electronics 110 are electrically coupled to the Edison screw 103 such that the electrical connection may be made from the Edison screw 103 to the lamp electronics 110. The lamp electronics may comprise a printed circuit board 108 which includes the power supply, including large capacitor and EMI components that are across the input AC line along with the driver circuitry as described herein. The circuit board 108 may be mounted to the housing 105 and, in one embodiment, is mounted to the top wall 105*a* of housing 105. The space 107 may be entirely enclosed by the housing 105 and Edison screw 103 such that the lamp electronics 110 may be thermally insulated or decoupled from the LED assembly 130, 1130 such that heat generated by the LED assembly 130, 1130 is not conducted to the lamp electronics 110. In some embodiments the top 105*a* and the body 105*b* of the housing 105 may be made as a one-piece component. In other embodiments the top 105*a* and the body 105*b* may be separate components that are secured together after the electronics 110 are located in the housing 105. Where the housing body 105*b* and housing top 105*a* are of a one-piece construction the lamp electronics 110 may be inserted into the housing 105 through an opening 111 at the bottom of the housing 105. The opening 111 is closed by the Edison screw 103 when the Edison screw is secured to the housing 105.

In some embodiments, a driver and/or power supply 110 are included in the base 102 as shown. Base 102 may include the power supply or driver and form all or a portion of the electrical path between the mains and the LEDs 127. The base 102 may also include only part of the power supply circuitry while some smaller components reside with the LED assembly 130, 1130. In one example embodiment, the inductors and capacitor that form part of the EMI filter are in the Edison base. Suitable power supplies and drivers are described in U.S. patent application Ser. No. 13/462,388 filed on May 2, 2012 and titled "Driver Circuits for Dimmable Solid State Lighting Apparatus" which is incorporated herein by reference in its entirety; U.S. patent application Ser. No. 12/775,842 filed on May 7, 2010 and titled "AC Driven Solid State Lighting Apparatus with LED String Including Switched Segments" which is incorporated herein by reference in its entirety; U.S. patent application Ser. No. 13/192,755 filed Jul. 28, 2011 titled "Solid State Lighting Apparatus and Methods of Using Integrated Driver Circuitry" which is incorporated herein by reference in its entirety; U.S. patent application Ser. No. 13/339,974 filed Dec. 29, 2011 titled "Solid-State Lighting Apparatus and Methods Using Parallel-Connected Segment Bypass Circuits" which is incorporated herein by reference in its entirety; U.S. patent application Ser. No. 13/235,103 filed Sep. 16, 2011 titled "Solid-State Lighting Apparatus and Methods Using Energy Storage" which is incorporated herein by reference in its entirety; U.S. patent application Ser. No. 13/360,145 filed Jan. 27, 2012 titled "Solid State Lighting Apparatus and Methods of Forming" which is incorporated herein by reference in its entirety; U.S. patent application Ser. No. 13/338,095 filed Dec. 27, 2011 titled "Solid-State Lighting Apparatus Including an Energy Storage Module for Applying Power to a Light Source Element During Low Power Intervals and Methods of Operating the Same" which is incorporated herein by reference in its entirety; U.S. patent application Ser. No. 13/338,076 filed Dec. 27, 2011 titled "Solid-State Lighting Apparatus Including Current Diversion Controlled by Lighting Device Bias States and Current Limiting Using a Passive Electrical Component" which is incorporated herein by reference in its entirety; and U.S. patent application Ser. No. 13/405,891 filed Feb. 27, 2012 titled "Solid-State Lighting Apparatus and Methods Using Energy Storage" which is incorporated herein by reference in its entirety.

The AC to DC conversion may be provided by a boost topology to minimize losses and therefore maximize conversion efficiency. The boost supply is connected to high voltage LEDs operating at greater than 200V. Examples of boost topologies are described in U.S. patent application Ser. No. 13/462,388, entitled "Driver Circuits for Dimmable Solid State Lighting Apparatus", filed on May 2, 2012 which is incorporated by reference herein in its entirety; and U.S. patent application Ser. No. 13/662,618, entitled "Driving Circuits for Solid-State Lighting Apparatus with High Voltage LED Components and Related Methods", filed on Oct. 29, 2012 which is incorporated by reference herein in its entirety. Other embodiments are possible using different driver configurations or a boost supply at lower voltages.

Figure 3:
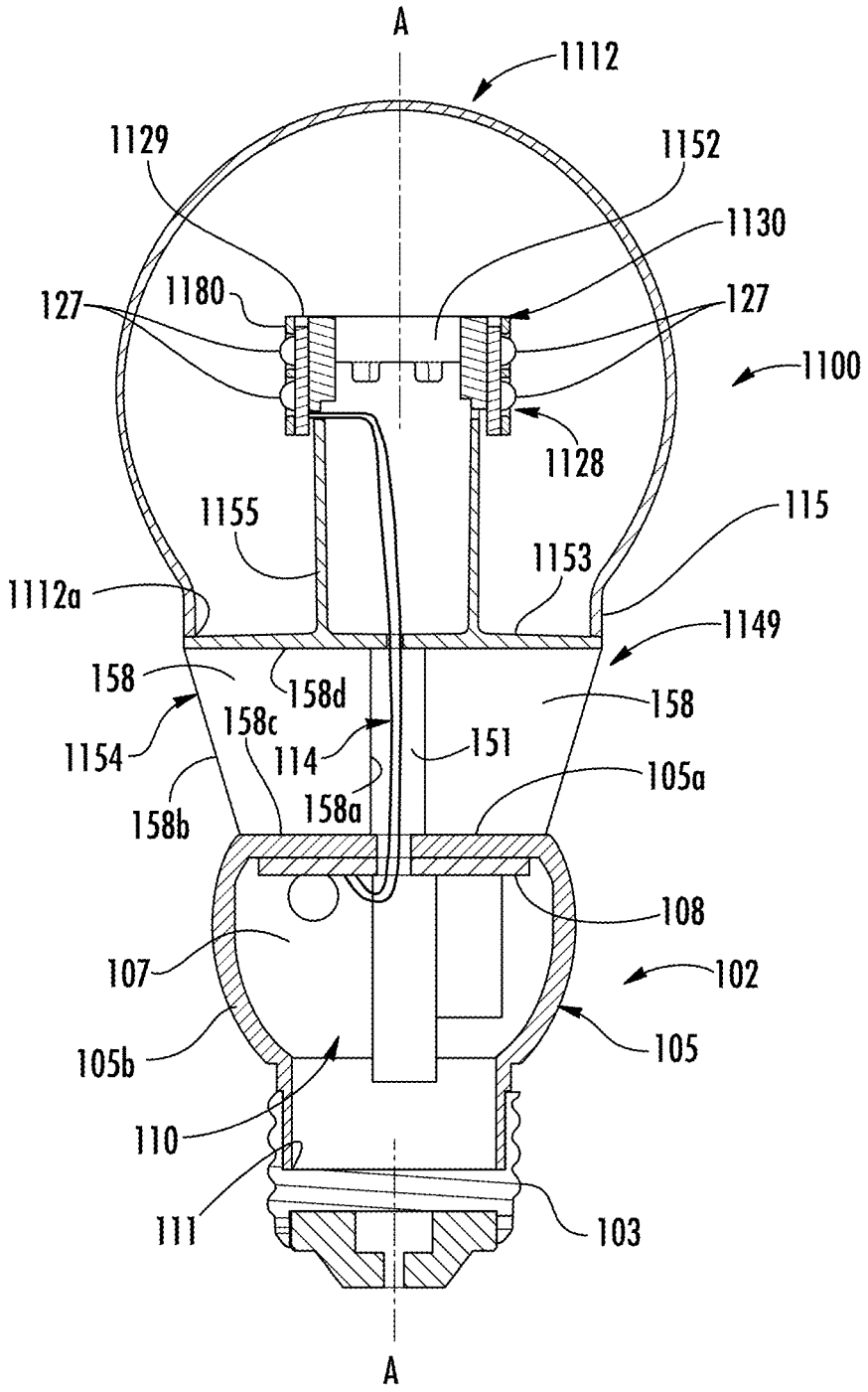
FIG. 3 is a section view of another embodiment of a lamp of the invention similar to FIG. 2.

With the embodiments of FIGS. 1-3, as with many other embodiments of the invention, the term "electrical path" can be used to refer to the entire electrical path to the LED's 127, including an intervening power supply disposed between the electrical connection that would otherwise provide power directly to the LEDs and the LED array, or it may be used to refer to the connection between the mains and all the electronics in the lamp, including the power supply. The term may also be used to refer to the connection between the power supply and the LED array. Electrical conductors 114 run between the LED assembly 130, 1130 and the lamp base 102 to carry both sides of the supply to provide critical current to the LEDs 127 as will be described.

The LED assembly 130, 1130 is contained in an optically transmissive enclosure 112, 1112 through which light emitted by the LEDs 127 is transmitted to the exterior of the lamp. In the embodiment of FIG. 3 the enclosure 1112 may be entirely optically transmissive where the entire enclosure defines the exit surface. In the embodiment of FIGS. 1 and 2 the enclosure 112 may be partially optically transmissive where the enclosure comprises an optically transmissive exit surface 122 and a reflective surface 101 for reflecting light to the exit surface. The enclosure 112, 1112 may be made of glass, quartz, borosilicate, silicate, polycarbonate, other plastic or other suitable material. The enclosure may be of similar shape to that commonly used in standard BR and/or PAR incandescent bulbs (FIGS. 1-2) or to A series bulbs (FIG. 3). In some embodiments, the exit surface of the enclosure may be coated on the inside with silica, providing a diffuse scattering layer that produces a more uniform far field pattern. The enclosure may also be etched, frosted or coated. Alternatively, the surface treatment may be omitted and a clear enclosure may be provided. The enclosure 112, 1112 may also be provided with a shatter proof or shatter resistant coating. While in some embodiments a shatter proof coating may be applied in other embodiments such a coating may be eliminated as will hereinafter be described. It should also be noted that in this or any of the embodiments shown here, the optically transmissive enclosure or a portion of the optically transmissive enclosure could be coated or impregnated with phosphor or a diffuser.

The LED assembly 130, 1130 may be implemented using a printed circuit board ("PCB") or other similar component which may be referred by in some cases as an LED board 129, 1129. The lamp 100, 1100 comprises a solid-state lamp comprising a LED assembly 130, 1130 with LEDs 127. Multiple LEDs 127 can be used together, forming an LED array 128. The LEDs 127 can be mounted on or fixed within the lamp in various ways. The LEDs 127 in the LED array 128 include LEDs which may comprise an LED die disposed in an encapsulant such as silicone, and LEDs which may be encapsulated with a phosphor to provide local wavelength conversion, as will be described later when various options for creating white light are discussed. A wide variety of LEDs and combinations of LEDs may be used in the LED assembly 130, 1130 as described herein. The LEDs 127 of the LED array 128, 1128 are operable to emit light when energized through the electrical path.

In some embodiments, the LED board 129, 1129 may comprise a PCB, metal core printed circuit board (MCPCB), flex circuit, lead frame or other similar structure. The LED board 129, 1129 may be made of a thermally conductive material. The entire area of the LED board 129, 1129 may be thermally conductive such that the entire LED assembly 130, 1130 transfers heat to the heat sink 149, 1149. In some embodiments, the LED board 129, 1129 of the LED assembly 130, 1130 may comprise a lead frame made of an electrically conductive material such as copper, copper alloy, aluminum, steel, gold, silver, alloys of such metals, thermally conductive plastic or the like. In other embodiments, the board 129, 1129 comprises a PCB such as a metal core PCB (MCPCB). The MCPCB comprises a thermally and electrically conductive core made of aluminum or other similar pliable metal material. The core is covered by a dielectric material such as polyimide. Metal core boards allow traces to be formed therein. The flex circuit may comprise a flexible layer of a dielectric material such as a plastic, polymeric, polyimide, polyester or other material to which a layer of copper or other electrically conductive material is applied such as by adhesive. Electrical traces are formed in the copper layer to form electrical pads for mounting the electrical components such as LEDs 127 and other lamp electronics on the flex circuit and for creating the electrical path between the components. The copper layer may be covered by a protective layer or layers. In other embodiments the LED board 129, 1129 may comprise a hybrid of such structures. Other structures for the LED board 129, 1129 may also be used. In one embodiment, the exposed surfaces of the LED assembly 130, 1130 may be coated with silver or other reflective material to reflect light inside of enclosure 112, 1112 during operation of the lamp. The LED board 129, 1129 may comprise a series of anodes and cathodes arranged in pairs for connection to the LEDs 127. An LED or LED package containing at least one LED 127 is secured to each anode and cathode pair where the LED/LED package spans the anode and cathode. The LEDs/LED packages may be attached to the LED board by soldering. While specific embodiments of LEDs are described herein, a greater or fewer number of anode/cathode pairs and LEDs may be used. Moreover, more than one LED board 129, 1129 may be used to make a single LED assembly 130. Electrical connectors or conductors such as traces connect the anode from one pair to the cathode of the adjacent pair to provide the electrical path between the anode/cathode pairs during operation of the LED assembly 130.

In one method, the LED board 129, 1129 is formed as a flat member as shown in lamp 100. In the directional lamp 100 of FIGS. 1-2, the LED assembly 130 is positioned between the heat sink 149 and the enclosure 112 at the open neck 112*a* of the enclosure 112 with the LEDs 127 facing generally away from the base 102 towards the exit surface 122 of the enclosure. Because a PAR and BR lamp are directional lamps this orientation of the LEDs 127 directs most of the light directly out of the exit surface 122 of the lamp. Light that is not emitted directly out of the exit surface may be reflected by the reflective surface 101 of the enclosure 112 toward the exit surface 122 such that the light is projected from the lamp 100 in a desired directional beam.

In other embodiments the LED board may have a three-dimensional shape where a MCPCB or lead frame is formed as a flat member and is bent into the desired three dimensional shape as shown in FIG. 3. The LED board 1129 may be bent or folded or otherwise shaped such that the LEDs 127 provide the desired light pattern. In the embodiment of FIG. 3 the LED board 1129 is formed as a cylinder with the LEDs 127 disposed about the axis A-A of the cylinder such that light is projected outward. The LEDs 127 may be arranged around the perimeter of the LED assembly 1130 to project light radially. Because the LED board 1129 is pliable and the LED placement on the substrate may be varied, the LED board may be formed and bent into a variety of configurations. The angles of the LEDs and the number of LEDs may be varied to create a desired light pattern. A "three-dimensional" LED assembly as used herein and as shown in the drawings means an LED assembly where the substrate comprises mounting surfaces for different ones of the LEDs that are in different planes such that at least some of the LEDs mounted on those mounting surfaces are also oriented in different planes. In some embodiments the planes are arranged such that the LEDs are disposed over a 360 degree range. The substrate may be bent from a flat configuration, where all of the LEDs are mounted in a single plane on a generally planar member, into a three-dimensional shape where different ones of the LEDs and LED mounting surfaces are in different planes.

In the omnidirectional lamp of FIG. 3, the LEDs 127 are arranged at or near the optical center of the enclosure 1112 in order to efficiently transmit the lumen output of the LED assembly through the enclosure 112. The most efficient transmission of light through a transparent or semitransparent surface is when the light incident to the surface is normal to the surface. For example, if the enclosure is a perfect sphere, an omnidirectional light source located at the center of the sphere provides the most efficient transmission of light through the enclosure because the light is normal to the surface of the enclosure at all points on the sphere's surface. In the omnidirectional lamp of the invention the LEDs 127 are arranged at or near the optical center of the enclosure 1112 to maximize the amount of light that is normal to the surface of enclosure 1112.

The form factor of the lamp may follow the form factor of traditional incandescent bulbs. In one embodiment, the enclosure and base are dimensioned to be a replacement for an ANSI standard A series bulb such that the dimensions of the lamp 100 fall within the ANSI standards for an A series bulb. In one embodiment, the lamp 100 is configured to be a replacement for an ANSI standard A19 bulb such that the dimensions of the lamp 100 fall within the ANSI standards for an A19 bulb. The dimensions may be different for other ANSI standards including, but not limited to, A21 and A23 standards. In other embodiments the lamp 100 may be dimensioned to be a replacement for a standard PAR incandescent bulb, such as a PAR-38 bulb, or a BR-style lamp as shown in FIGS. 1 and 2. In some embodiments, the enclosure and base are dimensioned such that the dimensions of the lamp 100 fall within the ANSI standards for an PAR or BR series bulb. In other embodiments, the LED lamp can have any shape, including standard and non-standard shapes. In some embodiments, the LED lamp may be equivalent to standard watt incandescent light bulbs such as, but not limited to, 40 Watt or 60 Watt bulbs.

In some embodiments, the LED lamp 100 may provide 650 lumens with 8.1 W. In such an embodiment ten CREE® XBG LEDs may be used. Because the heat management performance of the lamp is very efficient the ten LEDs may be operated at a higher wattage to increase the lumen output. Alternatively, a fewer number of LEDs may be used that are operated at a higher wattage to provide the 650 lumens. For example, in one embodiment five CREE® XBG LEDs may be used to produce 650 lumens.

LEDs and/or LED packages used with an embodiment of the invention and can include light emitting diode chips that emit hues of light that, when mixed, are perceived in combination as white light. Phosphors can be used as described to add yet other colors of light by wavelength conversion. For example, blue or violet LEDs can be used in the LED assembly of the lamp and the appropriate phosphor can be in any of the ways mentioned above. LED devices can be used with phosphorized coatings packaged locally with the LEDs or with a phosphor coating the LED die as previously described. For example, blue-shifted yellow (BSY) LED devices, which typically include a local phosphor, can be used with a red phosphor on or in the optically transmissive enclosure or inner envelope to create substantially white light, or combined with red emitting LED devices in the array to create substantially white light.

A lighting system using the combination of BSY and red LED devices referred to above to make substantially white light can be referred to as a BSY plus red or "BSY+R" system. In such a system, the LED devices used include LEDs operable to emit light of two different colors. In one example embodiment, the LED devices include a group of LEDs, wherein each LED, if and when illuminated, emits light having dominant wavelength from 440 to 480 nm. The LED devices include another group of LEDs, wherein each LED, if and when illuminated, emits light having a dominant wavelength from 605 to 630 nm. A phosphor can be used that, when excited, emits light having a dominant wavelength from 560 to 580 nm, so as to form a blue-shifted-yellow light with light from the former LED devices. In another example embodiment, one group of LEDs emits light having a dominant wavelength of from 435 to 490 nm and the other group emits light having a dominant wavelength of from 600 to 640 nm. The phosphor, when excited, emits light having a dominant wavelength of from 540 to 585 nm. A further detailed example of using groups of LEDs emitting light of different wavelengths to produce substantially while light can be found in issued U.S. Pat. No. 7,213,940, which is incorporated herein by reference.

Referring again to FIGS. 1-2, the LED assembly 130 may be mounted to the heat sink 149 such that heat from the LED assembly is conducted to the heat sink. The heat sink 149 may comprise a heat conducting portion 152 that supports the LED assembly 130 to provide physical support and good surface-to-surface contact between the heat sink 149 and the LED assembly 130 to create a thermal path between the LED assembly 130 and the heat sink 149. In one embodiment the heat conducting portion 152 comprises a planar member 153 to which the LED assembly 130 is mounted. The LED board 129 is disposed transverse to the axis of the lamp A-A adjacent the opening 112*a* of the enclosure 112 such that the LEDs 127 are arranged to project light toward the exit surface 122. In a second embodiment (FIG. 3) the heat conducting portion 1152 comprises a tower 1155 that extends into the enclosure 1112 to support the LEDs 127 near the optical center of the enclosure 1112. The tower 1155 may be supported on a planar member 1153 disposed between the tower and the heat dissipating portion.

While the LED assembly 130, 1130 is shown in direct contact with the heat sink 149, 1149 intervening elements may be provided between the heat sink 149, 1149 and the LED assembly 130, 1130 provided that heat from the LED assembly 130, 1130 may be efficiently transmitted to the heat sink 149, 1149. In some embodiments a thermal epoxy may be used to connect the LED assembly 130, 1130 to the heat sink 149, 1149. In other embodiments mechanical connectors such as fasteners, a friction fit, crimping, male/female connectors may be used in place of or in addition to the thermal epoxy.

Electrical connectors 114, such as wires, may be used to connect the lamp electronics 110 to the LED assembly 130, 1130. In some embodiments the conductors 114 extend through an internal open space 151, in the heat sink 149, 1149. The electrical conductors 114 may be soldered to the LED assembly 130, 1130 and the lamp electronics 110. In other embodiments mechanical electrical connectors such as plug and socket arrangements may be used. In other embodiments, pressure contacts may be used to make the electrical connections. While wires are shown as the electrical conductors 114 other electrical interconnects may be used.

The heat sink structure 149, 1149 comprises a heat dissipating portion 154, 1154 that is mechanically and thermally connected to heat conducting portion 152, 1152. In one embodiment the heat sink 149, 1149 is made as a one-piece member of a thermally conductive material such as aluminum. The heat sink 149, 1149 may also be made of multiple components secured together to form the heat sink. Moreover, the heat sink 149, 1149 may be made of any thermally conductive material or combinations of thermally conductive materials. In some embodiments the LED assembly 130, 1130 may be directly thermally coupled to the heat dissipating portion 154, 1154 without the use of a separate heat conducting portion. The heat sink 149, 1149 may be formed in a wide variety of shapes and sizes provided that sufficient heat is conducted away from the LED assembly 130, 1130 that the operation and/or life expectancy of the LEDs are not adversely affected.

The heat dissipating portion 154, 1154 is thermally coupled with the heat conducting portion 152, 1152 such that heat conducted away from the LED assembly 130, 1130 by the heat conducting portion 152, 1152 may be efficiently dissipated from the lamp 100, 1100 by the heat dissipating portion 154, 1154. In one embodiment the heat conducting portion 152, 1152 and heat dissipating portion 154, 1154 are formed as one-piece. The heat dissipating portion 154, 1154 extends to the exterior of the lamp 100, 1100 such that heat may be dissipated from the lamp to the ambient environment. The LED assembly 130, 1130 may be thermally coupled to the heat sink 149, 1149 in a variety of manners. For example the LED assembly may be mounted directly on the heat sink such that the surface to surface contact creates the thermal couple between these elements. In some embodiments intervening thermally conductive elements may be between the LED assembly and the heat sink. For example, a thermal epoxy may be used both to secure the LED assembly to the heat sink and to thermally couple these elements. In other embodiments, the heat sink 149, 1149 may only comprise the heat dissipating portion 154, 1154 and the heat conducting portion may be integrated with the LED assembly 130, 1130 such that the integrated heat sink portion and LED assembly engage the heat dissipating portion 154, 1154. The heat dissipating portion 154, 1154 may comprise a plurality of heat dissipating members that are exposed on the outside of the lamp to facilitate the heat transfer to the ambient environment. In one embodiment, the heat dissipating members comprise a plurality fins 158 that extend outwardly to increase the surface area of the heat dissipating portion 154, 1154. The heat dissipating portion 154, 1154 and fins 158 may have any suitable shape and configuration although in one embodiment the fins comprise thin generally planar members. One particularly suitable arrangement of the fins will be described. In one embodiment the heat dissipating portion 154, 1154 is formed generally as a cylinder where one end of the heat dissipating portion 154, 1154 is attached to the top of the base 102 and the opposite end of the heat dissipating portion 154, 1154 is connected to the enclosure and/or the LED assembly.

Because the lamp electronics 110 may be located entirely in the base 102 and the heat sink 149, 1149 may be positioned between the base 102 and the LEDs 127 in the enclosure 112, 1112, the LEDs 127 are spaced from the lamp electronics 110 by the heat sink 149, 1149 such that heat generated by the LEDs may be dissipated from the lamp without being conducted to the lamp electronics in an amount that adversely affects the lamp electronics. While some heat may be conducted to the base 102 from the heat sink, the size of the heat sink, the distance between the LEDs and the lamp electronics, and the construction of the base and heat sink lowers the heat conducted to the lamp electronics in the base to a level that does not adversely affect the lamp electronics. The lamp electronics 110 do not extend beyond the top of the base and into the heat sink such that the physical space between the lamp electronics and the LEDs protects the lamp electronics from the heat generated by the LEDs and allows the heat sink to occupy substantially the entire area between the base and the enclosure while maintaining the form factor of the lamp to within the envelope for standard bulbs such as A series bulbs, BR style bulbs and PAR style bulbs. The arrangement of the fins allows air flow through the entire height of the heat sink between the LEDs and the base across and through the open heat sink.

The fins 158 comprise planar members that are configured such that the planes of the fins are arranged substantially parallel to the longitudinal axis of the lamp A-A. The fins 158 are arranged in a radial pattern where the inner edges 158*a* of the fins are disposed adjacent the longitudinal axis of the lamp and the outer edges 158*b* of the fins are disposed along the outer envelope of the lamp. The bottom edges 158*c* of the fins may be supported on the top wall 105*a* of the base 105 where the top wall is made of a thermally insulating material such as plastic. In this manner the heat that is conducted to the heat sink 149, 1149 may be isolated from the lamp electronics 110 by the base. Because the lamp electronics 110 are spaced from and may be substantially thermally isolated from the heat generated by the LED assembly, the lamp electronics may not have to be potted in the base. The upper edges 158*d* of the fins may be thermally and mechanically connected to the heat conducting portion 152, 1152.

Figure 4:
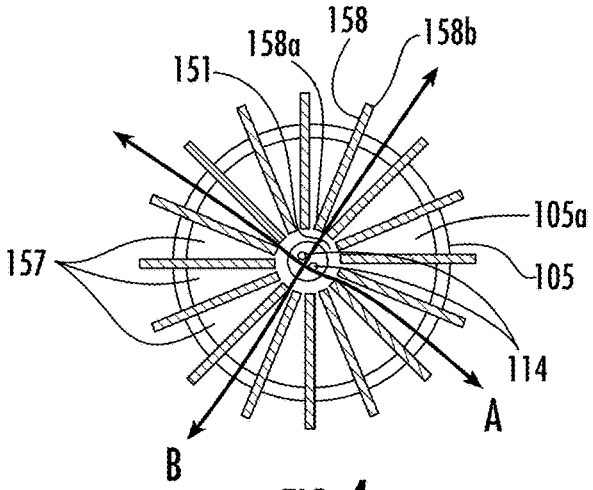
FIG. 4 is a section view taken along line 4-4 of FIG. 1.
Figure 5:
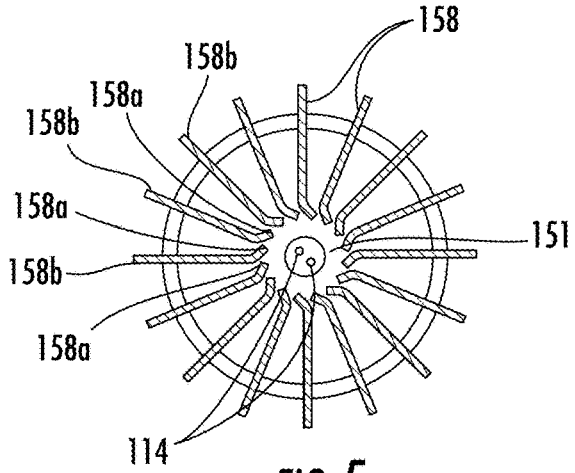
FIGS. 5 and 6 are section views similar to FIG. 4 of alternate embodiments of the lamp of the invention.
Figure 6:
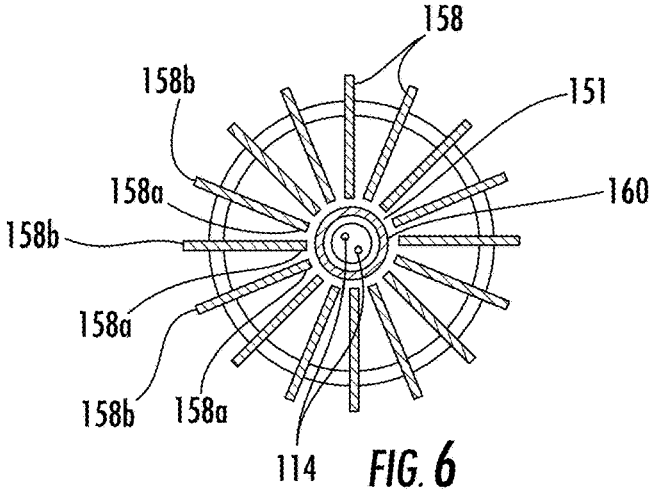

As shown in FIGS. 4-6 the inner edges 158*a* of the fins 158 do not connect to one another such that an internal open space 151 is formed in the center of the heat sink that communicates with the spaces 157 between the fins 158. As a result, air may circulate between the fins 158, through space 151 and across the heat sink as represented by arrows A and B, FIG. 4. While two arrows are used to represent the air flow it is to be understood that air may flow between each of the fins 158 in varying amounts and in varying directions. The air may circulate below and across the heat conducting portion 152, 1152 and across the fins 158 such that heat generated by the LED assembly 130, 1130 is dissipated to the ambient environment. The air flow across the heat sink may be described as "radial" in that air may flow completely across and through the heat sink without obstruction by an intervening structure such as a power supply, drivers or the like. For example in the embodiments of FIGS. 4 and 5 the only structure that extends into the heat sink is the conductors 114 and the surface area of these elements is small enough that they present no obstruction to air flow across the heat sink. The air may flow, although it is not limited to flow, across the diameter of a cylindrically shaped heat sink. Where the heat sink is not generally cylindrical in shape but has a more rectangular or polygon shape the radial air flow may be described as flowing diagonally across the heat sink. "Radial" air flow as used herein means flow or movement of air through a heat sink where the air may flow from one edge of the heat sink to an opposite edge of the heat sink across the center of the heat without substantial obstruction by an intervening element, such as a power supply, driver, base portion or the like and applies to both cylindrical heat sinks and polygonal heat sinks. Using an open heat sink structure allows the heat sink to dissipate a significant amount of heat from the LEDs such that the LEDs may be operated at relatively high current and voltage. Because directional lamps may be used in recessed lighting applications where the lamp is retained in a fixture that closely surrounds the lamp the use of a highly thermally efficient heat sink as described herein provides good thermal management.

The arrangement of the fins 158 creates open spaces that extend entirely through the heat sink 149, 1149. Also, the electrical conductors 114 extend through the internal open space 151 such that in some embodiments, the electrical conductors 114 may be visible. In some applications it may be aesthetically undesirable to have the conductors 114 visually exposed or to have the heat sink be completely see-through. To avoid this visual appearance the fins 158 and heat sink may be configured to cover the internal open space 151 while still allowing air to flow through the heat sink. In one embodiment, as shown in FIG. 5, the inner edges 158*a* of the fins 158 are bent or flared or otherwise formed at an angle relative to the main portion of the fins. The inner edges 158*a* are shaped such that the flared portions hide the interior space 151 of the heat sink while allowing air flow between the fins and through the heat sink. While the inner edge 158*a* of one fin may overlap with the adjacent fin, the inner edges 158*a* of the fins are spaced from one another to allow air flow between the fins and through the interior space 151. From the exterior of the lamp the fins 158 appear to form a solid member where the spaces between the fins 158 are not readily visible such that when viewed from the exterior of the lamp a user cannot see entirely through the heat sink and conductors 114 are not visible.

In another embodiment, shown in FIG. 6, a tube or conduit 160 is positioned in the interior open space 151 where the inner edges 158*a* of the fins 158 approach but are not connected to the tube such that a space is created between the fins and the tube. The electrical conductors 114 may be located in the tube 160. From the exterior of the lamp the tube 160 and fins 158 appear to form a solid member where the spaces between the fins 158 and the tube 160 are not readily visible such that when viewed from the exterior of the lamp a user cannot see entirely through the heat sink and conductors 114 are not visible. The spaces between the fins 158 and the tube 160 allow air to flow over the fins and through the heat sink. The tube 160 may be made of thermally conductive material and may be secured to the heat conducting portion and/or the base and may form part of the heat sink. In other embodiments apertures may be formed in the tube 160 to allow air flow through the tube 160. Further, the fins 158 may be attached to the tube 160 at selected points while still allowing air flow between or through the fins and tube using apertures or through holes.

As described herein, the lamp comprises an LED portion containing the LEDs, an electronics portion with at least a portion of the drive electronics, and an open space there between in which the heat sink is located. The LED portion and the electronics portion can be held together by tube 160 which passes wires from electronics to the LEDs and/or the heat sink. The tube 160 can be plastic (to increase the thermal isolation between the LED portion and the electronics portion) or the tube 160 can be a thermally conductive material, such as aluminum, (to improve thermally coupling of the two portions). The two portions can also be coupled together via other members extending between them such as the fins or other members extending between the portions to connect them but still provide open space between them permitting air flow from one side to the other (laterally between the two halves). The members can be made of a thermally resistive material such as plastic and/or metal for improved thermal coupling between the portions. Depending on the embodiment, the amount of thermal coupling between the two portions can depend on which side has a more efficient heat sink to dissipate heat. If both sides use an effective heat sink then the thermal coupling between the two portions can be reduced. If one side has a better heat sinking arrangement and/or is less sensitive to heat, then better thermal coupling between the two portions may be desired. The open space between the portions promotes more efficient heat dissipation from both portions.

The enclosure 112, 1112 may be attached to the heat sink 149, 1149. In one embodiment, the LED assembly 130, 1130 and the heat conducting portion 152, 1152 are inserted into the enclosure 112, 1112 through the opening 112*a*, 1112*a* in neck 115, 1115. The neck 115, 1115 and heat dissipating portion 154, 1154 are dimensioned and configured such that the rim of the enclosure 112, 1112 sits on the upper surface of the heat dissipation portion 154, 1154 with the heat dissipation portion 154, 1154 disposed at least partially outside of the enclosure 112, 1112 between the enclosure 112, 1112 and the base 102. To secure these components together a bead of adhesive may be applied to the upper surface of the heat dissipating portion 154. The rim of the enclosure 112, 1112 may be brought into contact with the bead of adhesive to secure the enclosure 112, 1112 to the heat sink 149, 1149 and complete the assembly. Mechanical connectors may be used in place of or in addition to the adhesive to secure the enclosure to the heat sink. Once the heat sink/LED assembly and enclosure subcomponent is completed, the subcomponent may be attached to the base 102 as a unit. The heat sink may be attached to the base 102 using adhesive, a mechanical connection or combinations of connection mechanisms.

Figure 7:
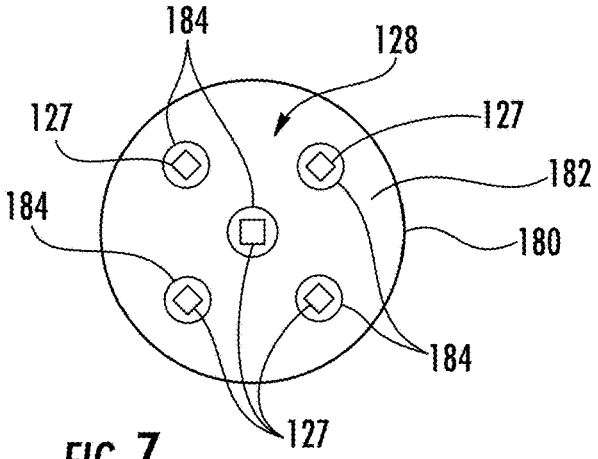
FIGS. 7 and 8 are plan views of the LED assembly and protective cover.
Figure 8:
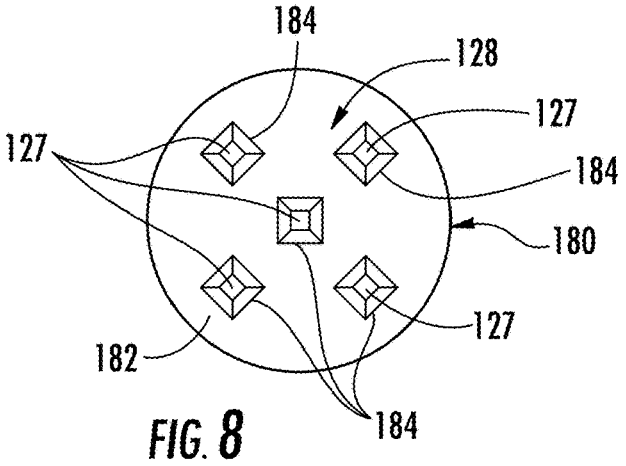
Figure 9:
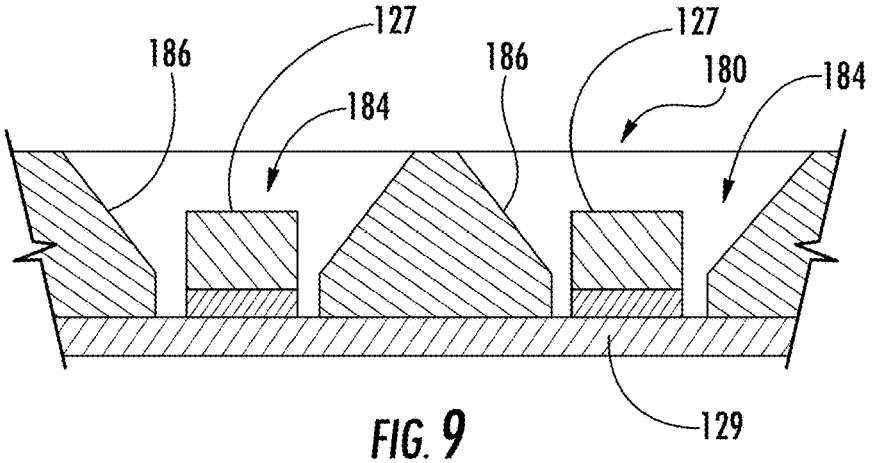
FIG. 9 is a partial section view of the LED assembly and the protective cover.

Standards may require that in the event the enclosure 112, 1112 is broken or shattered a person cannot contact live electrical components that may be exposed on the interior of the lamp. In some embodiments a safety coating may be applied to the enclosure to prevent the enclosure from shattering. The shatterproof coating functions to hold the shattered enclosure pieces together such that access to the internal electrical components is prevented even if the rigid (e.g. glass or plastic) enclosure is broken. In some embodiments it may be desirable to eliminate the shatterproof coating to eliminate processing steps, associated costs or the like. To eliminate the need for the shatterproof coating, or for use in addition to a shatter proof coating, a safety cover may be provided to cover the LED assembly such that live electrical components in the enclosure are covered even if the enclosure shatters. The cover 180, 1180 comprises an electrically insulating member 182 that is shaped and dimensioned to cover the LED board 129, 1129 such that electrical traces, contacts and other live electrical elements are covered by the member 182. The cover may be made of plastic or other dielectric material. Where the LED board 129 is planar, the cover 180 may also be planar; however, where the LED board 1129 has a three-dimensional shape, the cover 1180 has a mating shape. The cover 180, 1180 may be attached to the LED board 129, 1129 or the cover 180, 1180 may be attached to the heat sink and/or enclosure. Referring to FIGS. 7-9 the member 182 comprises a plurality of apertures 184 arranged such that when the member 182 is mounted over the LED board 129, 1129 one or more of LEDs 127 is inserted into one of the apertures 184 such that light from the LEDs 127 is projected through the apertures 184 into the enclosure 112. The openings 184 may include a flared surface 186 that widens as the aperture 184 extends away from the LED board 129, 1129 to create reflective surfaces to reflect any light emitted laterally by the LEDs 127 toward the exit surface of the lamp. The apertures 184 may be circular as shown in FIG. 7 or the apertures may be rectilinear to match a rectangular or square shaped LED as shown in FIG. 8. In one embodiment the cover 180 may extend over the entire surface of the heat sink such that the enclosure 112, 1112 is mounted to the cover 180 with the cover 180 disposed between the enclosure 112, 1112 and the heat sink 149, 1149 as shown in FIG. 2. In other embodiments, the cover 180 may extend only over the LED board 129, 1129 such that the top perimeter edge of the heat sink 149, 1149 is exposed and the enclosure 112, 1112 is mounted directly to the heat sink 149. The top surface of the cover 180 may be reflective and may be a diffuse or Lambertian reflector and may be made of a white highly reflective material such as injection molded plastic, white optics, PET, MCPET, or other reflective materials such as a specular material such as injection molded plastic or die cast metal (aluminum, zinc, magnesium) with a specular coating. A reflective coating may also be applied to the cover via vacuum metallization or sputtering, and could be aluminum or silver. The reflective surface may also be a formed film, formed aluminum, or the like. The cover 180 is disposed such that the cover isolates the live electrical components from a user in the event that the enclosure 112, 1112 is shattered or otherwise damaged. Some standards allow gaps of minimum distances. In these situations a small gap (e.g. 1 mm) may be allowed between the cover and the active electrical substrate such as, for example, between the apertures 184 and the LEDs 127. In addition to electrically isolating the live electrical components the cover also prevents a lateral force from impacting the LEDs 127 that could otherwise dislodge or damage the LEDs.

Figure 10:
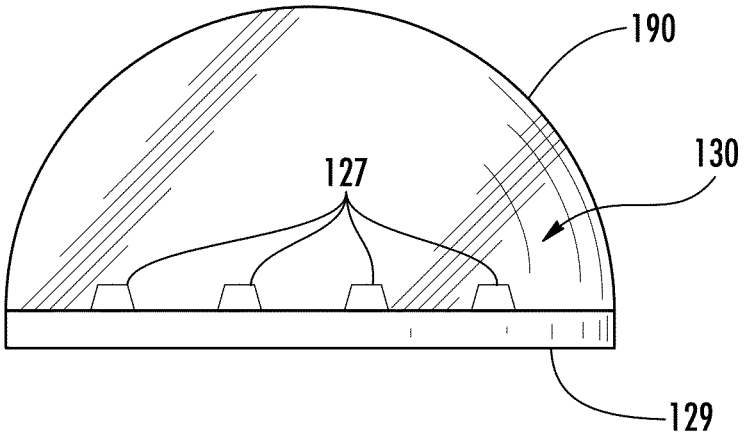
FIG. 10 is a side view of an alternate embodiment of the LED assembly and a protective cover.

In an alternate embodiment the electrical isolation and physical protection provided by cover 180 may be provided by a glass dome as shown in FIG. 10. The glass dome is disposed over the substrate and any active electrical elements to electrically and physically isolate the LEDs 127 and other active electrical components from a user in the event of enclosure 112, 1112 failure.

With respect to the features described above with various example embodiments of a lamp, the features can be combined in various ways. The embodiments shown herein are examples only, shown and described to be illustrative of various design options for a lamp with an LED array.

Although specific embodiments have been shown and described herein, those of ordinary skill in the art appreciate that any arrangement, which is calculated to achieve the same purpose, may be substituted for the specific embodiments shown and that the invention has other applications in other environments. This application is intended to cover any adaptations or variations of the present invention. The following claims are in no way intended to limit the scope of the invention to the specific embodiments described herein.

The invention claimed is:

1. A lamp comprising:

an at least partially optically transmissive enclosure;

a base comprising lamp electronics defining a longitudinal axis extending from the base to the enclosure;

at least one LED located in the enclosure and operable to emit light when energized through an electrical path from the base;

a heat sink comprising a heat dissipating portion that is at least partially exposed to the ambient environment, the heat dissipating portion comprising a plurality of flat planar fins arranged substantially parallel to the longitudinal axis, the plurality of flat planar fins having inner edges that are disposed adjacent to and extend along the longitudinal axis such that the plurality of flat planar fins extend substantially radially from the longitudinal axis and define spaces between the plurality of flat planar fins, the inner edges being spaced from one another such that an interior open space is formed at the center of the heat sink that communicates with the spaces to allow air flow radially across the heat sink wherein the inner edges of the plurality of fins, along the entire length thereof, are flared and overlap but are spaced from one another to cover the interior open space while allowing air flow radially across the heat sink.

2. The lamp of claim 1 wherein the heat sink comprises a heat conducting portion that is thermally coupled to the at least one LED and to the heat dissipating portion.

3. The lamp of claim 2 wherein the heat dissipating portion and the heat conducting portion are a single piece.

4. The lamp of claim 2 wherein the heat conducting portion foi is a tower that extends into the enclosure.

5. The lamp of claim 2 wherein the heat conducting portion defines a planar member disposed at a first end of the enclosure.

6. The lamp of claim 2 wherein a LED board supports the at least one LED and is mounted on the heat conducting portion.

7. The lamp of claim 6 wherein the LED board is thermally conductive.

8. The lamp of claim 6 further comprising a cover disposed over the LED board comprising an aperture through which the at least one LED emits light, the cover being electrically non-conductive.

9. The lamp of claim 1 wherein the enclosure comprises a reflective surface and an optically transmissive exit surface through which light is emitted from the lamp.

10. The lamp of claim 9 wherein the reflective surface generates a directional light pattern.

11. The lamp of claim 9 wherein the reflective surface is parabolic.

12. The lamp of claim 1 wherein the enclosure is entirely optically transmissive.

13. The lamp of claim 1 wherein an electrical conductor connects the at least one LED to the base, the electrical conductor extending through the interior open space.

14. The lamp of claim 1 wherein the base comprises an Edison screw.

* * * * *